United States Patent [19]

Bullock, III

[11] Patent Number: 4,691,834

[45] Date of Patent: Sep. 8, 1987

[54] CAP AND NECK STRUCTURE FOR A WIDE MOUTH JAR

[75] Inventor: Joseph J. Bullock, III, Atherton, Calif.

[73] Assignee: Bankers Trust Company, New York, N.Y.

[21] Appl. No.: 858,811

[22] Filed: May 2, 1986

Related U.S. Application Data

[63] Continuation-in-part of Ser. No. 689,859, Jan. 3, 1985, Pat. No. 4,625,876, which is a continuation of Ser. No. 515,275, Jul. 19, 1983, abandoned, which is a continuation-in-part of Ser. No. 387,550, Jul. 12, 1982, Pat. No. 4,438,857.

[51] Int. Cl.[4] ..... B65D 41/48

[52] U.S. Cl. ..... 215/232; 215/256; 220/270

[58] Field of Search ..... 215/256; 220/270

[56] References Cited

U.S. PATENT DOCUMENTS

| | | | |
|---|---|---|---|
| 2,994,449 | 8/1961 | Ritzenhoff | 215/256 |
| 3,109,548 | 11/1963 | Wood | 215/256 |
| 3,961,566 | 6/1976 | Westphal et al. | 220/256 X |
| 4,127,209 | 11/1978 | Ritzenhoff | 215/256 X |
| 4,166,552 | 9/1979 | Faulstich | 215/256 |
| 4,438,857 | 3/1984 | Bullock | 215/256 |
| 4,484,687 | 11/1984 | Bullock | 215/256 |

FOREIGN PATENT DOCUMENTS

| | | | |
|---|---|---|---|
| 798284 | 7/1958 | United Kingdom | 215/256 |
| 1442548 | 7/1976 | United Kingdom | 215/256 |

*Primary Examiner*—Donald F. Norton
*Attorney, Agent, or Firm*—Julian Caplan

[57] ABSTRACT

A cap for a wide-mouth container has a short inner skirt and a longer outer skirt. The outer skirt has upper and lower internal locking beads which are preferably interrupted with gaps between bead sections. Above the lower locking bead is a circumferential score line. A portion of the outer skirt below the score line is cut away in a horizontal and then an arcuate slit to form a pull tab extending parallel to the score line. The pull tab is joined to the outer skirt by a frangible link. Various locations of said link are disclosed. The container neck is thin walled, having an internal top flange terminating in a first sealing surface which bears against the top of the inner skirt, a groove below the last-mentioned surface and a second sealing surface below the groove which also bears against the inner skirt. The neck also has upper and lower external beads each having shoulders on their lower edges under which the upper and lower internal locking beads of the cap seat. The neck curves outward in a lower shoulder immediately below the bottom edge of the skirt. The cap cannot be pried off with the fingers until the user grips the tab and tears off the portion of the outer skirt below the score line.

15 Claims, 18 Drawing Figures

CAP AND NECK STRUCTURE FOR A WIDE MOUTH JAR

CROSS-REFERENCE TO RELATED APPLICATION

This application is a continuation-in-part of copending application, Ser. No. 06/689,859, filed Jan. 3, 1985, now U.S. Pat. No. 4,625,876 which, in turn, was a continuation of abandoned application, Ser. No. 515,275, filed July 19, 1983, which was a continuation-in-part of application Ser. No. 387,550, filed July 12, 1982, and now U.S. Pat. No. 4,438,857. The subject matter of the patents and applications set forth in this paragraph are incorporated herein by reference.

BACKGROUND OF THE INVENTION

1. Field of the Invention

This invention relates to a new and improved cap and neck structure for a wide-mouthed jar of the type used to package mayonnaise and other products. The cap is preferably used with a plastic jar having a neck which is hereinafter described in detail. One of the features of the invention is the fact that the closure is tamper-evident in that, in order to obtain access to the contents of the jar, the bottom edge of the skirt must be torn off, thereby providing evidence of tampering.

2. Description of Related Art

Reference is made to patent application No. 06/689,859 and U.S. Pat. No. 4,438,857, and the references cited in the files thereof. The present invention differs from this prior art in that the tear tab is connected to the body of the skirt with a link which prevents damage to the skirt prior to the time that the skirt is torn in order to obtain access to the jar, all as hereinafter appears.

SUMMARY OF THE INVENTION

U.S. Pat. No. 4,438,857 differs from prior tamper-evident closures owned by the assignee of this application in that the tear tab is torn away horizontally rather than vertically upwardly. A problem with horizontal tear tabs is the possibility that the end of the tab may be bent outwardly away from the skirt of the cap or broken off, or the cap skirt may be accidentally torn, indicating to the purchaser of the jar that there has been tampering when there actually has not been tampering. Application No. 689,859 discloses a horizontal tear tab which is joined to the major portion of the skirt by a thin link which holds the end of the tab flush against the side of the jar and eliminates the possibility that the end of the tab will be torn or bent.

The present invention provides an improved means of linking the tear tab to the main portion of the skirt. Thus, a curved slit is formed in the skirt of the cap, the inner end of which comprises an extension of the horizontal scoreline of the cap, said slit curving downwardly toward the bottom edge of the skirt in an arc of about 180° and terminating a short distance from the bottom edge of the skirt. The uncut portion of the skirt between the bottom edge of the slit and the bottom of the edge of the skirt comprises a link for the purpose heretofore mentioned. In order to start tearing the tear tab, the user pulls the curved portion of the skirt within the curved slit, thereby breaking the link. By continuing to pull on the end of the tear tab, the lower part of the skirt is removed.

Various locations for positioning the link are disclosed. Thus the link may be at the bottom edge of the skirt. Alternatively, the link may connect the top edge of the tear tab to the remainder of the skirt thereabove. The link may be straight or angled. Single or plural links may be formed.

Thus the present invention is an improved structure which is easier to manufacture and easier for the user to manipulate than any prior constructions of this general type.

In the preferred form of the invention which is described hereinafter in detail, the means for holding the cap on the jar neck resembles that of prior Application Ser. No. 689,859. Several versions of this structure are shown in said application, any one or more of which may be used in connection with the specific details herein illustrated and hereinafter described. The cap of the invention is applied to the neck by pushing down on the cap so that beads on the interior of the outer skirt of the cap snap over meeting beads on the exterior of the neck. The structure is such that the cap may be applied by standard capping machinery such as that used to apply plastic overcaps to metal cans for coffee and the like.

To remove the cap, the user grips the end of the tear tab and pulls the tear tab horizontally, thereby fracturing the link which joins the lower edge of the tear tab to the skirt.

After the bottom of the skirt has been torn off, the cap may be removed by pulling it off the neck. To facilitate such operation a peripheral external flange is provided. The underside of this flange may be beveled, such as at a 45° angle, so that a dishonest patron cannot pull the cap off the neck before the skirt has been torn. The angle on the underside of the flange prevents the fingernails from being dug into the cap flange.

Alternatively, the flange may be truncated in a short vertical outer edge.

In a modification of the invention, the flange has a flat underside which intersects the skirt wall at about a 90° angle. Hence the flange bends upward rather than providing a prying surface for tampering with the contents of the container without removing the skirt. Furthermore, a strong force applied to the flange tends to tear the flange, giving evidence of tampering.

The structure whereby the lower end of the skirt may be torn off is unique, enabling the consumer to grip a tab and, by pulling thereon, tear off the lower part of the skirt.

In the preferred form of the invention hereinafter described, the beads on the interior wall of the skirt of the cap are interrupted both above and below the horizontal tear line of the cap. Such interruption of beads makes it possible for the skirt to stretch when the cap is being installed on the bottle neck in standard capping machinery. Therefore the force required to seal the cap on the neck is lessened and any tendency of the neck of the bottle to be crushed is avoided. An additional advantage of this feature of the invention is the fact that the container neck may be blow-molded of a thinner plastic material since the tendency to crush the neck is reduced.

To further improve the tamper-evident characteristic of the cap, a foil liner may be installed in the cap to seal to the container neck after the cap is applied.

Other objects of the present invention will become apparent upon reading the following specification and referring to the accompanying drawings in which similar characters of reference represent corresponding parts in each of the several views. In the drawings.

DESCRIPTION OF PREFERRED EMBODIMENTS

Figure 5:
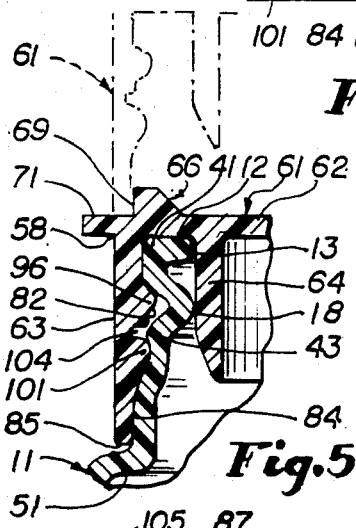
FIG. 5 is similar to FIG. 4 showing the cap seated on the neck.
Figure 4:
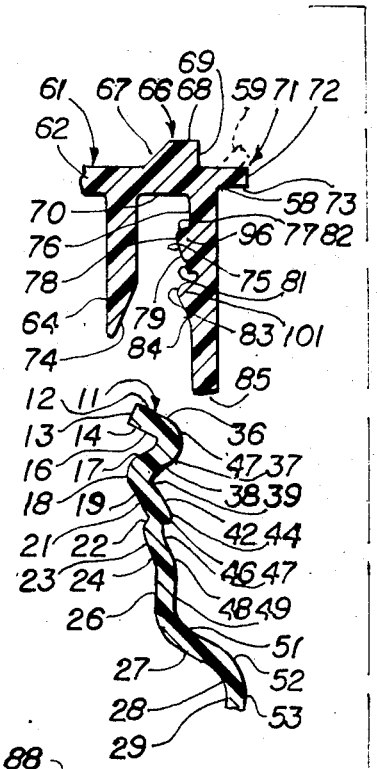
FIG. 4 is an exploded sectional view showing the cap and neck prior to assembly.

The neck 11 of the container is preferably formed of blow-molded polyethylene or similar plastic material. Neck 11 has a top flange 12 which may be inwardly-upwardly directed at an angle of about 20° as shown in FIG. 4. Alternatively, flanges 12 may be flat. When cap 61 is applied, the slanted flange 12 of FIG. 4 is depressed, as shown in FIG. 5, providing tight sealing at its inner edge and also at its base.

Considering first the interior of the neck, below top flange 12 is top internal vertical wall 13, which is one of the sealing surfaces making the closure airtight. Below wall 13, the neck extends outwardly in a stretch 14 to a top internal groove 16. Thereupon the neck extends in a downwardly-inwardly extending ledge 17 to second internal vertical wall 18 which has a diameter substantially the same as that of wall 13 and constitutes the second sealing surface. Below wall 18 is first downward outwardly slanted wall 19 which terminates in second internal groove 21. The groove 21 merges with downward inward slanted wall 22 which merges with third internal vertical wall 23 of considerably greater diameter than the walls 13 and 18, which, in turn, merges with second outward downward slanted wall 24 and then fourth internal vertical wall 26. The cap extends outward below wall 26 for a purpose which hereinafter appears. In order to maintain the thin-walled structure, the interior of the neck curves outwardly to a curved bead 28 which then merges with inwardly-downwardly curved surface 29. Below surface 29 the structure of the neck is a matter of choice.

Considering now the exterior of the neck 11, surface 12 has a curved outer corner 36 below which is top vertical wall 37, which terminates in top horizontal inward directed shoulder 38, thereby providing top neck bead 41. Below bead 41 is a top groove or second vertical wall 39. Below groove 39 is downward outward slanted surface 42, below which is a short vertical wall 44 to provide second external neck bead 43. The diameter of bead 43 is somewhat greater than that of bead 41. Below surface 44 is second horizontal inward directed shoulder 46 below which is fourth vertical wall 47 which is of slightly greater diameter than the top groove or wall 39. Second downward outward slanted wall 48 is below wall 47 and this terminates in fifth vertical wall 49. Below wall 49 is a horizontally extending shoulder 51 which projects outwardly and prevents a dishonest consumer from prying upward the lower edge of the cap skirt hereinafter discussed. Shoulder 51 terminates in a downward outward curved wall 52 which then terminates in a downward inward curved wall 53 substantially parallel to wall 29 on the interior of the neck. Below wall 53, the construction of the neck is a matter of choice.

Cap 61 has a top disc 62 from the bottom of which extend outer skirt 63 and inner skirt 64. Inner skirt 64 is of lesser length than outer skirt 63 and has substantially vertical inner and outer walls, the inner wall terminating in a downward inward slanted bevel 74 which facilitates seating the cap 61 on the neck 11. As is best shown in FIG. 5, the surfaces 13 and 18 of the neck 11 seal against the outer surface of the interior skirt, or plug, 64 and make the closure airtight. At the same time, the underside 70 of the disc 62 between the two skirts seals on the top edge 12 of neck 11. On the top of disc 62 substantially directly above the underside surface 70 is a stacking ring 66 which projects upwardly a short distance. Ring 66 has an upward outward slanted surface 67, a horizontal top edge 68 and a substantially vertical downward outer edge 69. As best shown in FIG. 5 the lower edge of the skirt of a superimposed cap nests immediately outside the surface 69 of the stacking ring 66, so that a series of caps may be superimposed.

After the skirt of the cap has been torn off (as hereinafter explained) the upper portion 105 of the cap functions as a reclosure cap for repeated snapping onto and off of the neck 11. To facilitate such removal of the reclosure cap, a peripheral flange 71 is provided on the disc 62 extending beyond the outer substantially vertical surface of the outer skirt 63. However, in order to prevent dishonest persons from removing the cap before the lower portion of the skirt has been torn off, flange 71 is formed with a short vertical wall 72 which terminates in an inward horizontal wall 73. The flange 71 is sufficiently flexible so that a dishonest person cannot dig his fingernails under the flange 71 to pry the cap off the neck before the skirt 63 is torn, since the flange bends (see FIG. 4).

Turning now to the configuration of the inside of the skirt 63, below surface 70 is an inner vertical wall 76 of approximately the length of bead 41 of neck 11. Wall 76 terminates in an inward extending shoulder 77. Shoulder 77 terminates in a downward outward slanted surface 78 which completes the definition of the internal cap bead 96 which locks under the bead 41 of the neck and seats in groove 39. As hereinafter described, the bead 96 is not continuous, but is interrupted. Surface 78 terminates in an outward downward slanted wall 75 below which is a vertical wall 79. The interior of the skirt 13 below wall 79 extends in an outward slanted surface 81 terminating in groove 82. Below groove 82, the wall has a downward inward slanted surface 83 and thence a downward outward slanted surface 84, the surfaces 83 and 84 defining the interrupted second cap bead 101 which locks under neck bead 43. Below surface 83, the cap is downward outward slanted in surface 84 terminating in the bottom edge 85 of the cap.

Directing attention now to FIG. 5, it will be seen that the neck beads 41 and 43 snap into the areas immediately above the internal cap beads 96 and 101 respectively. The lower edge 85 of the outer cap skirt fits tightly upon the surface 51 of the neck, preventing the fingernails from gripping below the edge 85 to pull the cap off.

Figure 3:
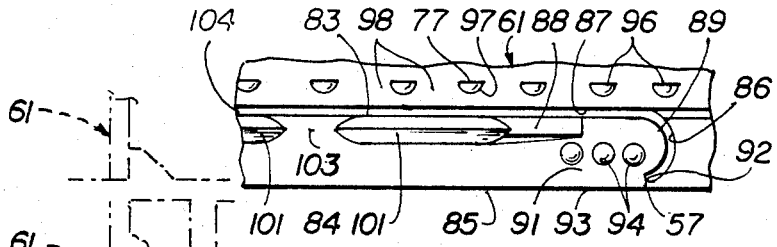
FIG. 3 is a fragmentary enlarged view showing the interior of the skirt of the cap developed in a plane.

Directing attention now to FIG. 3, the interrupted upper bead sections 96 have horizontal top edges 77 and arcuate bottom edges 97. Between the bead segments 96 are gaps 98.

The lower bead sections 101 have substantially horizontal top surfaces 83 and substantially horizontal bottom surfaces 84. The ends 102 of the bead sections 101 taper and there are gaps 103 between the sections. Bead sections 96 are preferably small and are spaced apart in gaps 98 approximately one and one-half times the length of each section 96. The gaps 103 between the lower bead sections 101 are, on the contrary, short. Bead sections 101 are approximately five and one-half times the length of bead sections 96.

Between the bead sections 96 and 101 is a horizontal scoreline or groove 104. In fact, the groove 104 is in close proximityto the top edge 83 of bead sections 101. It is along the groove 104 that the lower portion of the skirt is torn, thereby removing the bead sections 101.

At one location around the circumference of the skirt 63, a horizontal slit 87 is formed through the skirt 63 in line with groove 104, and constituting an extension of said groove. A curved slit 86 joins slit 87 and extends in an approximately 180° arc down toward the bottom edge 85 of skirt 63 to a terminus spaced upward from bottom edge 85 a short distance. Thus, there is a frangible link 57 joining the end 91 of the tear tab of the cap to the main portion of the skirt. In order to remove the cap, the user inserts a fingernail or prying tool in the slit 86 or 87 and pulls the end 91 of the tab away from the skirt causing the link 57 to fracture. Continued pulling on the tab end 91 pulls the entire portion of the skirt below the horizontal scoreline 104 away, thereby tearing away the lower bead sections 101. To facilitate such tearing action, protuberances 94 may be formed on the inside of the end 91 which may be gripped by the fingers more conveniently. Further, to prevent the user from unintentionally tearing the skirt below the lower bead 101 a reinforcement 88 is formed on the inside of skirt 63 below slit 87 and extending up to the nearest interrupted bead section 101.

After the skirt has been torn, the remaining portion of the cap 61 functions as a reclosure cap 105. Cap 105 may be removed from the neck 11 by pulling upward on the flange 71, so that the bead sections 96 snap out from under the bead 41 and its shoulder 38. The reclosure cap 105 may be reapplied merely by pushing downward and may be removed and reapplied repeatedly as required.

Figure 1:
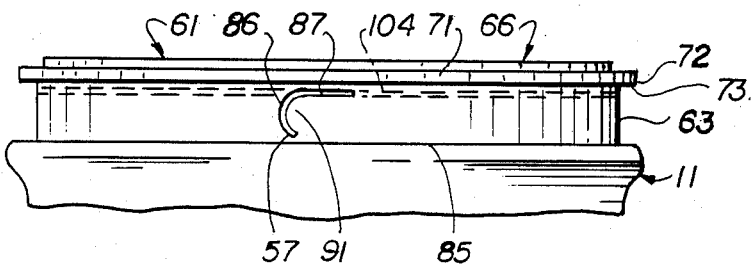
FIG. 1 is a side elevation of the cap of the present invention and the upper end of a container neck with which it is used.
Figure 2:
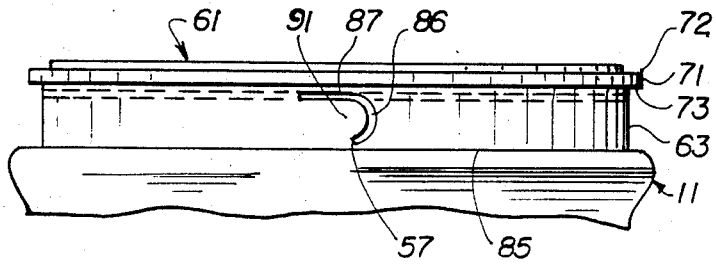
FIG. 2 is a view similar to FIG. 1 showing the tear tab constructed so as to be pulled in the direction opposite that of FIG. 1.

FIG. 2 is similar to FIG. 1 but shows the tear tab extending in the opposite direction. It has been found that some patrons find it easier to remove the lower skirt if the tab extends in one direction than the other.

Figure 5A:
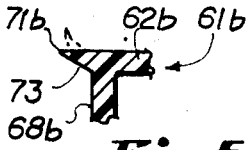
FIGS. 5A and 5B are fragmentary views of modifications of portions of the structure of FIG. 5.

The flange 71 shown in FIGS. 1–5 is generally rectangular in cross-section and is preferably flexible, as shown by reference numeral 59 in FIG. 4. The function of the flange 71 is to facilitate removing the reclosure cap 105. The flexible nature of the flange 71 is important in preventing a dishonest patron from using the flange to pull off the cap when the skirt 63 is intact. FIG. 5A shows a modifiction wherein the flange **71*b* has a horizontal top surface in line with the top surface of disc 62*b*. However, the underside 73 of flange 71*b* slants downwardly inwardly to merge with the outside of the skirt 63*a*. The slanted nature of the surface 73 prevents the fingernails from digging under the flange to pull the cap off. In the form of the invention shown in FIG. 5A, as shown in dotted lines, the flange 71*b* may be sufficiently flexible to bend upward as does the flange 71 of FIG. 4. However, it will be understood that the flexible nature of flange 71*b*** is not essential.

Figure 5B:
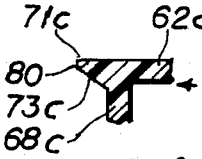

In FIG. 5B the flange **71*c* resembles the flange 71*b* of FIG. 5A except that the outer edge thereof is truncated as shown by reference numeral 80. This provides a thicker flange 71*b* which may be necessary to facilitate using the flange to pry off the reclosure cap 105**.

Figure 6:
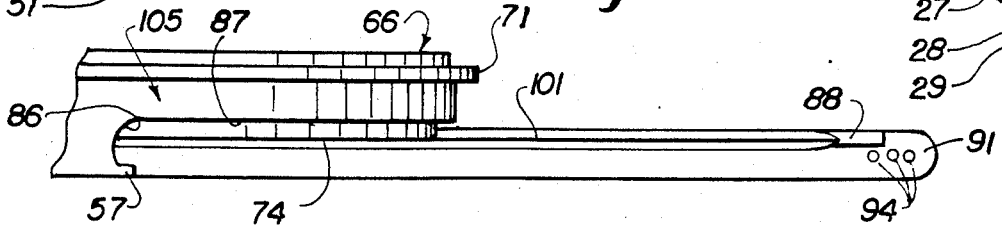
FIG. 6 is a side elevational view showing the tear strip of the cap of FIG. 1 partially torn away.

In FIG. 6 is shown a modification of the structure of FIG. 1 in that the bead 101 is continuous rather than being interrupted as shown in FIG. 3. In the preferred embodiment of FIGS. 1–5 the beads 96 and 101 are both interrupted. Either or both of the beads may be continuous, as illustrated in FIG. 6.

Figure 7:
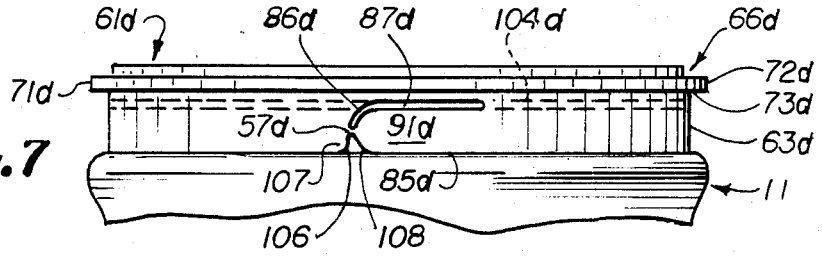
FIG. 7 is a view similar to FIG. 1 of a modification.
Figure 9:
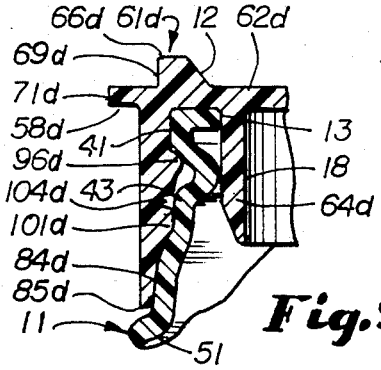
FIG. 9 is a view similar to FIG. 5 of the modification of FIG. 1.

The modification of FIGS. 7 and 9 shows a preferred modification of the structure previously described. Horizontal slit **87*d* is elongated a distance substantially greater than the slit 87 of FIG. 1 to enable the consumer to insert a fingernail, or a prying instrument into the slit 87*d* in order to break the link 57*d* more conveniently. As in the previous modification, the slit 87*d* is in alignment with and constitutes an extension of horizontal scoreline 104*d*. A short curved slit 86*d* extends through an arc of approximately 90° and terminates spaced upwardly from the bottom edge 85*d* of the cap 61*d*. A notch 106 is cut upward from the bottom edge 85*d*. One side 107 of notch 106 is substantially vertical and extends to the link 87*d*. The other side 108 of notch 106 curves upwardly in an arc of approximately 90° and terminates at link 57*d*. It will be seen that this modification differs from the preceding modification in that the link 57*d* is spaced upwardly from bottom edge 85*d*. The notch 106 makes it more convenient for the user to grip the tear tab at the bottom of the skirt to break the link 87*d***.

Figure 8:
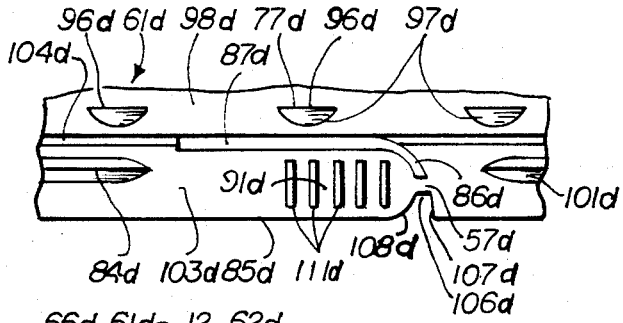
FIG. 8 is a view similar to FIG. 3 of the modification of FIG. 7.

The inside of tab **91*d* is formed with substantially vertical narrow, rectangular protuberances 111, herein shown as five in number to assist the user in gripping the tab to tear the skirt along score line 104*d*. It will be understood that the number and spacing of the protuberances 111 is subject to modification. Furthermore, the protuberances 111 shown in FIG. 8 may be substituted for the round protuberances 94 shown in FIG. 3** of the preceding modification and vice versa.

Figure 7A:
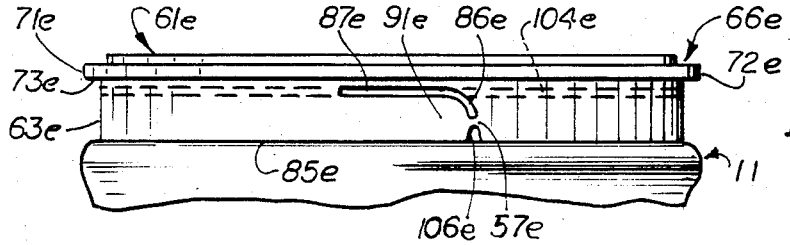
FIG. 7A is a view similar to FIG. 7 showing the tear tab constructed so as to be pulled in the direction opposite that of FIG. 7.

In FIG. 7A, the cap shown is substantially similar to that of FIG. 7, except that the slit **87*e* extends in the opposite direction. Thus, the tab 91*e* of FIG. 7A may be torn in the direction opposite that of the tab of FIG. 7**.

Figure 11:
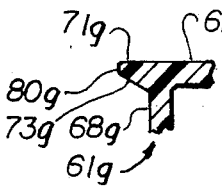
FIGS. 10 and 11 are views of the modification of FIG. 7 similar to FIGS. 5A and 5B, respectively.
Figure 10:
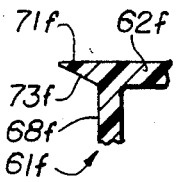

The flange **71*d* shown in FIG. 7 is similar to the flange 71 shown in FIG. 71. In FIG. 10 is shown a flange 71*f* similar to flange 71*b* of FIG. 5A. In FIG. 11** is shown a flange 71g similar to the flange 71c of FIG. 5B.

Figure 12:
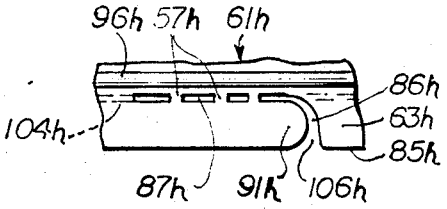
FIG. 12 is a fragmentary view similar to FIG. 8 of a modification.

FIG. 12 shows links 57h extending vertically between the end 91h of the tear tab to the portion of the skirt thereabove. It has been thought that some patrons experience difficulty in breaking links 57 or 57d. On the other hand, it is desirable that the end 91h of the tear tab be secured against tearing during transportation of the container. The structure of FIG. 12 enables the patron to more conveniently grip the end 91h and tear it to the left, thereby fracturing the links 57h. The number and spacing of links 57h is subject to variation but two such links are shown in FIG. 12.

Figure 13:
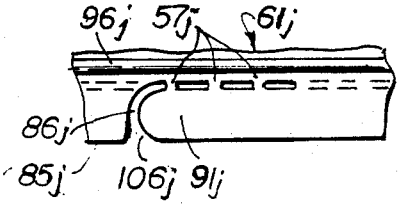
FIG. 13 is a view similar to FIG. 12 showing the tear tab constructed so as to be pulled in the direction opposite that of FIG. 12.

FIG. 13 shows a structure similar to FIG. 12 except that the curved slit 86j extends in the opposite direction as does the horizontal slit 57j.

Figure 14:
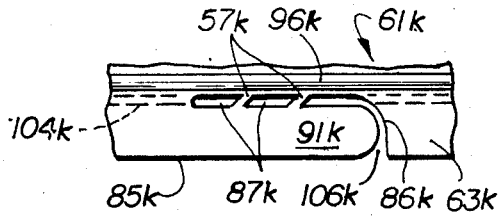
FIG. 14 is a view similar to FIG. 8 of a further modification.

FIG. 14 resembles FIG. 12 except that the links 57k are slanted. The slanted disposition of the links prevents premature fracture during the capping operation. It will be understood that the curved slit 86k and horizontal slit 87k may extend either in the direction shown in FIG. 14 or in the opposite direction.

Figure 15:
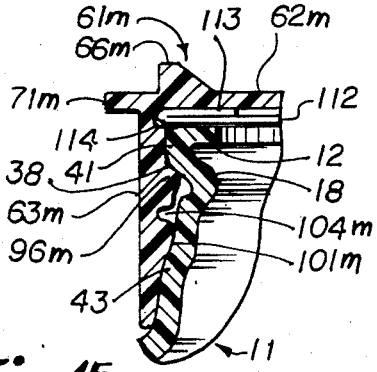
FIG. 15 is a view similar to FIG. 5 of a still further modification showing a foil seal.

FIG. 15 illustrates the use of the cap of FIGS. 1–14 with a foil seal 112. Although the cap shown in FIG. 15 resembles that of FIG. 5, it will be understood that any of the modified caps heretofore disclosed may be used and, further, that the neck structure 11 is subject to modification. Foil seal 112 is made of aluminum or other suitable material and is provided with an adhesive on its under surface. The seal 112 is installed inside the cap 61m at the time of its manufacture. When the cap 61m is applied to the bottle 11, the adhesive on the seal 112 sticks to the top flange 12. The adhesive may be melted by induction heating or other means as understood in the art. To facilitate removal of the seal 112 after the cap 61m has been removed by the consumer, a tab 113 integral with the seal 112 is folded over on top of the seal 112 and nests between the under side of the top disk 72m and the flange 12. When the consumer desires to remove the seal 112, he grasps the tab 113 and pulls the same, causing the disk 112 to be pulled away.

To further insure that the seal 112 will not be dislodged from the cap prior to its application to the neck 11, a groove 114 may be formed in the inside of skirt 63m immediately below the top disk 62m. The diameter of disk 112 is made sufficiently great so that the marginal edges thereof snap into the groove-114. When the cap 61m is removed from the neck 11, the adhesive causes the disk 112 to stick to the flange 12 and the margin of the seal disk 112 snaps out of the groove 114.

In other respects, the modification of FIGS. 5A, 5B, 7, 7A, and 10–15 resemble those of preceding modifications and the same reference numerals followed by the subscripts b, c, d, e, f, g, h, j, k and m respectively, are used to designate corresponding elements.

What is claimed is:

1. A cap of the type having a central top disc, a thin-walled substantially cylindricl outer skirt depending from said disc, first bead means on the interior of said outer skirt adapted to engage cooperating second bead means on the neck of a container, a circumferential score line in said outer skirt above at least a lower portion of said bead means, a portion of said outer skirt below said score line being cut away to form a pull tab extending in a direction parallel to said score line, whereby upon pulling said tab circumferentially, said outer skirt severs along said score line, said lower portion of said bead means being removed as said tab is pulled, the improvement comprising a horizontal slit formed in said outer skirt in line with said circumferential score line and extending in a curve to a terminus, the portion of said skirt within said slit comprising said tear tab, there being a frangible link between said tear tab and the adjacent portion of said skirt, said skirt being formed with a notch extending up to the bottom edge of said link and said terminus being at the upper edge of said link, said link being spaced up from said bottom edge to a position about midway of the height of said tear tab.

2. A cap according to claim 1 in which said notch has a second curve vertically in line with said first-mentioned curve.

3. A cap according to claim 1 in which said lower portion of said bead means is formed with bead sections with gaps spaced between said bead sections and which further comprises a thickening of said skirt along the upper edge of said tab merging with the nearest of said bead sections.

4. A cap according to claim 1 which further comprises at least one gripping protuberance formed on said tab.

5. A cap according to claim 4 in which said protuberance is circular.

6. A cap according to claim 4 in which said protuberance is rectangular and vertically elongated.

7. A cap according to claim 1 which further comprises a short inner skirt depending from said top disc spaced inward from said outer skirt.

8. A cap according to claim 1 in which said top disc has a peripheral flange extending beyond said outer skirt.

9. A cap according to claim 1 in which said top disc has a peripheral flange extending beyond said outer skirt, said flange being rectangular in cross section and joining the outer wall of said outer skirt in a sharp corner.

10. A cap according to claim 1 in which said top disc has a peripheral flange extending beyond said outer skirt, said flange having a top surface level with the top surface of said disc and a downward-inward slanted bottom surface.

11. A cap according to claim 10 in which the outer edge of said flange is truncated in a short vertical surface.

12. A cap according to claim 1 which further comprises a foil seal within said cap and adhesive on the lower surface of said foil seal.

13. A cap according to claim 12 which further comprises a tab extending from said foil seal, said tab initially being folded over said foil seal and tucked underneath said top disc.

14. In combination, a cap according to claim 1 and a container for said cap having a neck and having an inturned top flange, said flange terminating in an internal smooth first sealing surface bearing against the top of said inner skirt, a groove below said first sealing surface, an internal, smooth second vertical sealing surface below said groove, said second sealing surface bearing against said inner skirt, a first external neck bead, a second external neck bead spaced down from said first external neck bead, said external neck beads each having shoulders on their lower edges, said bead means of said cap comprising upper and lower internal beads locking under the shoulders of said first and second external beads of said neck, respectively.

15. The combination of claim 14 in which at least one of said internal beads of said cap is interrupted in a series of gaps spaced around the circumference of said outer skirt forming bead sections.

* * * * *